United States Patent [19]

Wysiekierski et al.

[11] Patent Number: 4,746,378

[45] Date of Patent: May 24, 1988

[54] PROCESS FOR PRODUCING $SM_2CO_{17}$ ALLOY SUITABLE FOR USE AS PERMANENT MAGNETS

[75] Inventors: Andrew G. Wysiekierski; Robert W. Fraser; Maurice A. Clegg, all of Fort Saskatchewan, Canada

[73] Assignee: Sherritt Gordon Mines Limited, Toronto, Canada

[21] Appl. No.: 930,062

[22] Filed: Nov. 12, 1986

Related U.S. Application Data

[63] Continuation of Ser. No. 700,916, Feb. 12, 1985, abandoned.

[30] Foreign Application Priority Data

Feb. 13, 1984 [GB] United Kingdom ..... 8403751

[51] Int. Cl.[4] ..... H01F 1/04

[52] U.S. Cl. ..... 148/101; 148/102

[58] Field of Search ..... 148/101, 102, 303

[56] References Cited

U.S. PATENT DOCUMENTS

| | | | |
|---|---|---|---|
| 4,172,717 | 10/1979 | Tokumaga et al. | 148/31.57 |
| 4,213,803 | 7/1980 | Yoneyama et al. | 148/31.57 |
| 4,221,613 | 9/1980 | Imaizumi et al. | 148/103 |
| 4,375,996 | 3/1983 | Tawara et al. | 148/31.57 |

FOREIGN PATENT DOCUMENTS

| | | | |
|---|---|---|---|
| 58-139406 | 8/1983 | Japan | 148/102 |

OTHER PUBLICATIONS

Fidler et al., "Domain Wall Pinning in REPM," Paper #5-7, VI Int'l. Workshop on Rare Earth Cobalt Magnets and their Applications, Austria 8/31-9/3/82.

Perry et al., "Permanent Magnetic Materials on the Basis of RE (Co,Cu)", 3rd European Conf. on Hard Magnetic Materials, Amsterdam, Sep. 17-19, 1974.

Shimida et al., "New Resin-Bonded $Sm_3Co_{17}$ Type Magnets" 3rd Int'l. Conf. on Ferrites, Kyoto, Japan, 1980.

Rabenberg et al., "Development of the Cellular Microstructure in the $SmCo_{7.4}$ Type Magnets", Paper #5.8, VI Int'l. Workshop on Rare Earth-Cobalt Magnets and their Application, Baden/Vienna Austria, Aug. 31-Sep. 3, 1982.

Kronmuller, "Nucleation and Propagation of Reversed Domain in RE-Co Magnets", Paper #S5, VI Int'l. Workshop on Rare Earth Cobalt Magnets and their Applications, Baden/Vienna, Austria, 8/31-9/3/82.

Shimada et al., "Developments in Magnetic Properties of Resin-Bonded $Sm_2TM_{17}$ Type Magnets," Paper #V-3, 5th Int'l. Workshop on Rare Earth-Cobalt Permanent Magnets and their Application, Roanoke, Va., Jun. 1981.

Hadjipanayis et al., "The Effect of Heat Treatment on the Microstructure and Magnetic Properties of a $Sm_2(Co,Fe,Cu,Zr)_{7.2}$ Magnet," Paper #SP-1 VI Int'l. Workshop on Rare Earth-Cobalt Magnets and their Applications, Baden/Vienna, Austria, 8/31-9/3/82.

Hadjipanayis et al., "Microstructure and Magnetic Domain Structure of 2:17 Precipitation-Hardened Rare--Earth Cobalt Permanent Magnets," Paper #5-9 VI Int'l. Workshop on Rare Earth-Cobalt Magnets and their Application Baden/Vienna Austria, 8/31-9/3/82.

Semones, "High Energy Density Rare Earth-Cobalt Magnets and D. C. Sewa Motors," Paper #1-2 VI Intn'l. Workshop on Rare Earth-Cobalt Magnets and their Application Baden/Vienna Austria, 8/31-9/3/82.

Yoneyama et al., "New Type Rare Earth Cobalt Magnets Bosedon $Sm_2(Co,Cu,Fe,M)_{17}$", Paper #VII-1, 3rd International Workshop on Rare Earth-Cobalt Magnets and their Applications, V. of Calif., San Diego, Jun. 27-30, 1978.

Yoneyama et al., "$Sm_2(Co,Cu,Fe,Zr)_{17}$ Magnets Having High; Hc and $(BH)_{max}$ 3rd Int'l. Conf. on Ferrites, Kyoto Japan, 9/1980.

Wallace, "Rare Earth Intermetallics" Academic Press, N.Y. 1973, pp. 170-172.

*Primary Examiner*—John P. Sheehan

*Attorney, Agent, or Firm*—Robert F. Delbridge; Arne I. Fors

[57] ABSTRACT

A process for producing an $Sm_2Co_{17}$ alloy suitable for use as a permanent magnet, the alloy also containing iron, copper and zirconium or a similar group IVB or VB transition metal, and optionally praseodymium in partial replacement of the samarium. The process comprises providing the alloy in a preliminary form, sintering the alloy at an elevated temperature to achieve a high density and high remanence, selecting a solution heat treatment temperature which is marginally below the solid+liquid/solid phase transformation temperature of said alloy, cooling the sintered alloy body from the sintering temperature to the solution treatment temperature in a controlled manner to put the alloy constituents into a substantially uniform 2-17 Sm-Co solid solution, holding at the solid solution treatment temperature, quenching the alloy to room temperature, reheating the alloy to a first aging temperature to transform the 2-17 Sm-Co solid solution into a structure comprising a network of the 1-5 Sm-Co phase within a 2-17 Sm-Co matrix, cooling the alloy to a second aging temperature in a controlled manner to cause regions of 2-17 Sm-Co phase to nucleate coherently within the 1-5 Sm-Co phase network and create lattice strain which results in high coercivity and good loop squareness, and cooling the alloy to room temperature.

13 Claims, No Drawings

PROCESS FOR PRODUCING $SM_2CO_{17}$ ALLOY SUITABLE FOR USE AS PERMANENT MAGNETS

This application is a continuation of application Ser. No. 700,916 filed Feb. 12, 1985, abandoned.

This invention relates to processes for producing $Sm_2Co_{17}$ alloy suitable for use as permanent magnets.

The advantages of rare earth cobalt alloy magnets are now well known. Such magnets are specially suitable for use in small electric motors, such as DC servomotors. It is also known that $Sm_2Co_{17}$ alloys have potential advantages for use as permanent magnets over $SmCo_5$ alloys(1). For example, DC motors using $Sm_2Co_{17}$ alloy magnets have lower weight and inertia and increased torque and acceleration compared to the use of $SmCo_5$ alloy magnets.

Various attempts have been made to provide $Sm_2Co_{17}$ alloys which can form permanent magnets having a high energy product $(BH)_{max}$ and a high intrinsic coercivity $_iH_c$. Typical prior art is shown for example in U.S. Pat. No. 4,172,717 issued Oct. 30, 1979 to Tokunaga et al(2), U.S. Pat. No. 4,213,803 issued July 22, 1980 to Yoneyama et al(3), U.S. Pat. No. 4,221,613 issued Sept. 9, 1980 to Imaizumi et al(4) and U.S. Pat. No. 4,375,996 issued Mar. 8, 1983 to Tawara et al(5). Other prior art is shown in the published literature(6,7,8,9,10).

As disclosed in the above-mentioned prior art, $Sm_2Co_{17}$ alloys are known which can form magnets having an energy product $(BH)_{max}$ in the range of 22 to 30 MGOe and an intrinsic coercivity $_iH_c$ in the range of 5.8 to 6.3 kOe(6,7). Later developments have resulted in the production of $Sm_2Co_{17}$ alloys which can produce magnets with higher coercivity, but this advantage has been offset by loss of energy product. For example, one $Sm_2Co_{17}$ alloy is now known which can produce magnets having an energy product $(BH)_{max}$ of 26 MGOe and an intrinsic coercivity $_iH_c$ of 15.0 kOe(7). Another $Sm_2Co_{17}$ alloy now known has an energy product $(BH)_{max}$ of 27 MGOe and an intrinsic coercivity $_iH_c$ of 10.0 kOe, see U.S. Pat. No. 4,375,996 mentioned above(5).

It is also known that, because of different magnetic hardening mechanisms, $Sm_2Co_{17}$ alloys are harder to magnetize from an unmagnetized state than $SmCo_5$ alloys. For example, in the construction of electric motors, it is the preferred practice to construct the field or stator assembly with unmagnetized magnets, and then magnetize the finished assembly as a single unit. This preferred industrial practice imposes an upper limit of about 25 kOe on the intensity of the magnetizing field which can be applied to the unmagnetized magnets of a typical assembly. Thus, in order to be useful in practice, an unmagnetized magnet must be capable of attaining its specified properties in a magnetizing field of 25 kOe. To date, it has not been possible to achieve this requirement with $Sm_2Co_{17}$ alloys with an energy product greater than 30 MGOe(6).

Thus, although it is acknowledged that $Sm_2Co_{17}$ alloys have potential advantages over other rare earth/-transition metal alloys such as $SmCo_5$ alloys, $Sm_2Co_{17}$ alloys have not yet become practically useful because improved coercivity has only been obtainable at the expense of energy product and also because such alloys have not been capable of attaining their specified properties in a magnetizing field up to about 25 kOe.

It is known that, to achieve a high energy product, one requirement is to have a high remanent induction and that this can be achieved by the addition of iron(11,12). A second requirement is to have a sufficiently high intrinsic coercivity and good second quadrant loop squareness, and these requirements can be achieved by the addition of copper and zirconium. Also, the predominant crystallographic structure must consist of cells of the 2-17 Sm-Co rhombohedral phase surrounded by boundary regions, i.e. a network, of the 1-5 Sm-Co hexagonal phase(13,14,15).

The prior art mentioned above discloses various processes for producing $Sm_2Co_{17}$ alloys. However, as also mentioned above, the $Sm_2Co_{17}$ alloys produced by such prior processes do not possess adequately high energy products as well as adequately high coercivities, and are not readily magnetizable in applied fields of 25 kOe.

Our co-pending application Ser. No. 931,916 filed on the same date as this application discloses an improved $Sm_2Co_{17}$ alloy composition in which the relative amounts of Sm, Fe, Cu and Zr are optimized within narrow ranges, with the actual Sm and Zr contents being varied in accordance with the oxygen and carbon content respectively. Such a composition enables an $Sm_2Co_{17}$ alloy with improved magnetic properties to be obtained. The contents of co-pending application Ser. No. 931,916 are hereby incorporated herein by reference.

Specifically, co-pending application Ser. No. 700,912 discloses an $Sm_2Co_{17}$ alloy containing by weight 22.5 to 23.5% Sm as an effective amount, 20.0 to 25.0% Fe, 3.0 to 5.0% Cu, 1.4 to 2.0% Zr as an effective amount, minor amounts of oxygen and carbon, an additional amount of Sm in the range of from about 4 to about 9 times the oxygen content of the alloy, an additional amount of Zr in the range of from about 5 to 10 times the carbon content of the alloy, the balance being cobalt, and said alloy having a crystallographic structure comprising cells of 2-17 Sm-Co rhombohedral phase surrounded by a continuous network of the 1-5 Sm-Co hexagonal phase.

The present invention provides an improved process for producing an $Sm_2Co_{17}$ alloy with improved magnetic properties.

The present invention is based partly on the discovery that the magnetic properties of $Sm_2Co_{17}$ alloys can be improved by producing such alloys by means of a process in which a sintering step is followed by a solid solution heat treatment step, with the alloy being cooled from a sintering temperature to a solid solution heat treatment temperature in a controlled manner such that all the alloying elements are put into uniform solid solution.

It has been found that such controlled cooling from the sintering temperature to the solid solution heat treatment temperature enables all the constituents to be dissolved into a homogeneous solid solution and enables improved magnetic properties to be obtained in an $Sm_2Co_{17}$ alloy. For example, it is possible for the alloy to have a relatively high iron content (to provide high remanent induction) without the 2-17 Sm-Co phase being rendered unstable, and to have a relatively high samarium content to provide good second quadrant loop squareness. With prior art processes, it was found that the presence of a high iron content causes the required 2-17 Sm-Co rhombohedral phase to become unstable, with resultant transformation to iron-rich phases and consequent deterioration of magnetic properties, especially remanent induction.

By using a process in accordance with the present invention, it is possible to produce a permanent magnet which attains its specified properties in a magnetizing field of about 25 kOe, has an energy product $(BH)_{max}$ of at least 30 MGOe and has a satisfactory intrinsic coercivity $_iH_c$ of 14–16 kOe. A magnet in accordance with the present invention can also have a satisfactory remanent induction $B_r$ of at least about 11.5 kG and a better loop squareness in the second quadrant, i.e. $H_K$ of approximately 9.0 kOe.

It has been found that the initial alloy body should be sintered at the highest possible temperature in the liquid + solid region to achieve full density and high remanent induction. The sintering temperature may be at least about 1200° C. at at least the end of the sintering step. The sintering temperature should be such that the alloy consists at that temperature of a mixture of liquid and solid phases to promote rapid sintering. The predominant solid phase consists of 2–17 Sm-Co grains, with these being surrounded by a liquid phase comprising a CuSm phase which also contains a small amount of a Zr-rich phase.

The sintering process may be carried out in an inert atmosphere such as argon, or in hydrogen or in a vacuum, or in a combination of these. In the case of sintering solely in an atmosphere of argon the possibility exists that some argon may be trapped in pores within the sintered alloy. This undesirable occurrence can be minimized by sintering initially at a somewhat lower temperature in a vacuum so as to decrease the porosity and then increasing the temperature in an argon atmosphere to achieve full density. Similarly it is not practical to sinter entirely in a vacuum as excessive loss of samarium would result and the preferred procedure would be to sinter initially at a lower temperature in a vacuum and then change to an argon atmosphere before raising the temperature to the desired higher level. Alternatively the alloy may be sintered initially in an atmosphere of hydrogen at a somewhat lower temperature, for example 1150° C. for 30 min, to close the internal porosity, followed by heating to the range of 1200°–1215° C. in an atmosphere of argon and holding at that temperature for 10 min.

In accordance with the invention, the sintered alloy body is cooled in a controlled manner from the sintering temperature to a solid solution heat treatment temperature to ensure homogeneous equilibrium dissolution of the CuSm and Zr-rich phases into solid solution in the stable 2–17 Sm-Co phase. A relatively high iron content renders such dissolution more difficult to achieve since the high iron content reduces the temperature range within which the stable 2–17 Sm-Co solid phase exists as a single phase. However, the controlled cooling from the sintering temperature to the solution heat treatment temperature in accordance with the invention enables this problem to be overcome.

If a sintered alloy body with relatively higher iron content is cooled too rapidly from the sintering temperature to the solid solution heat treatment temperature, the CuSm and Zr-rich phases remain concentrated at the grain boundaries. The localized high concentration of samarium results in transformation of the 2–17 Sm-Co phase to an Fe-rich phase with lower remanent induction. Also, in the same grain boundary region, zirconium may be rejected from solid solution, with a resultant adverse effect on loop squareness. The possibility of occurrence of such undesired effects is significantly reduced by slow cooling from 1170° C. to the solid solution heat treatment temperature in accordance with the present invention.

After slow cooling to the solid solution heat treatment temperature, which is marginally below the solid+liquid/solid phase transformation temperature for the alloy composition and which may for example be from about 1120° to about 1150° C., the alloy body is maintained at this temperature for a period of time (for example about 2 hours) to improve the dissolution of the alloying elements and to remove any structural faults by annealing. The alloy body is then quenched from the solid solution heat treatment temperature to a temperature below 800° C. at a rate of about 10° C./s, and thereafter to room temperature. In our co-pending application Ser. No. 700,912 it is disclosed that optionally part of the samarium may be replaced by praseodymium. In this case the solid+liquid/solid phase transformation temperature will be lower and the solid solution heat treatment temperature must be lower, in the range 1120°–1145° C.

The alloy body is then aged to develop the 1–5 Sm-Co phase network. The first aging temperature will be generally in the range of 800°–860° C. but must be precisely chosen depending on the composition, in particular on the zirconium content. A preferred first aging temperature in the present invention is 845°±5° C. for 20 hours.

After the first aging step, it is necessary to cool the alloy body in a controlled manner to effect the required magnetic hardening, that is to say achieve the required intrinsic coercivity and good loop squareness. Such controlled cooling may be from the first aging temperature to about 600° C. at a rate preferably about 2° C./min and from about 600° C. to a secondary aging temperature in the 400°–420° C. at about 1° C./min. A preferred secondary aging treatment in the present invention is 410° C. for 10 hours. The alloy body is then cooled to room temperature.

It is postulated that during cooling from the first aging temperature and during holding at the second aging temperature regions of 2–17 Sm-Co phase nucleate coherently within the 1–5 Sm-Co phase network thereby creating lattice strain and magnetic hardening[16]. When magnetically hardened, the 1–5 Sm-Co phase network serves as a barrier to magnetic domain wall motion and creates the required intrinsic coercivity and good second quadrant loop squareness.

An alloy body in accordance with one embodiment of the invention was produced in preliminary form with the following composition by weight: 22.7% effective Sm, 22.0% Fe, 4.6% Cu, 1.5% effective Zr, and balance cobalt. The alloy body was sintered for 30 min in hydrogen at 1150° C., and for 10 min in argon at 1205° C. The sintered alloy body was then cooled to 1150° C. at a rate of 2° C./min.

The alloy body was then subjected to solid solution heat treatment at a temperature of 1140° to 1150° C. for 2 hours. After the solid solution heat treatment, the alloy body was quenched to room temperature. A micrograph showed that a uniform single phase solid solution structure was achieved.

The alloy body was then aged by reheating to 815° C. and maintained at that temperature for 20 hours, then the alloy body was cooled to 600° C. at a rate of 2° C./min and from 600° to 410° C. at a rate of 1° C./min, held at 410° C. for 10 hours and then cooled to room temperature. A micrograph was taken and showed a uniform structure of 2-17 Sm-Co grains.

Another alloy body having the same composition as the previous alloy body was prepared and subjected to the same treatment as the previous alloy body, except that cooling from the sintering temperature to the solid solution heat treatment temperature was effected at a rapid rate of 10° C./s. The alloy was then reheated to 815° C. and aged as described above. A micrograph was taken and showed large grains constituting the 2-17 Sm-Co phase, with a CuSm black phase and a Zr-rich white phase being seen in the grain boundary area.

The alloy bodies were then magnetized in a magnetizing field of 25 kOe and the resulting magnetic properties were measured, as shown in the following Table.

| | $B_r$ (kG) | ${}_iH_c$ (kOe) | $H_K$ (kOe) | $(BH)_{max}$ (MGOe) |
|---|---|---|---|---|
| Slow cooling | 11.7 | 15.8 | 9.0 | 30.8 |
| Rapid cooling | 11.7 | 14.9 | 6.0 | 28.0 |

The superior magnetic properties of the alloy body which was subjected to slow cooling from the sintering temperature to the solid solution heat treatment temperature in accordance with the invention are readily apparent.

By way of further comment, it was found that in the sintering process it is advantageous to sinter first in an atmosphere of hydrogen followed by a further period in an atmosphere of argon. For example, a preferred sintering process is to sinter for 30 min in hydrogen at 1150° C., change the furnace atmosphere to argon, increase the temperature at 4°-5° C./min to 1205° C. and maintain this temperature for 10 min. It was observed that during the first sintering treatment the density of the product increases by pore closure with entrapment of some hydrogen. In the second sintering treatment in argon the internal hydrogen is removed by diffusion and the remaining pores are closed to full density. No argon entrapment occurs during the second sintering treatment as the external porosity has been sufficiently closed by the initial sintering treatment, and no hydrogen remains in the alloy as the final sintering treatment is carried out in argon. If the entire sintering treatment is carried out in argon, some argon is trapped within the internal porosity and results in residual porosity, lower density and lower remanence ($B_r$) in the finished magnet.

To achieve improved magnetic properties, e.g. higher energy product, systematic increases were made in the Fe content and it was found that it was necessary to adjust the other elements accordingly and to adjust the temperature and time of the solution heat treatment to achieve the basic requirement of putting all the alloying elements into uniform solid solution. For example, to increase the Fe content from 15% to 22% it was also necessary to reduce the Cu content from 6.0% to 4.6% and the effective Zr content from 2.5% to 1.5% and to modify the solution heat treatment from one hour at 1180° C. to a controlled cooling procedure from the sintering temperature of 1205° C. to the solution heat treatment temperature which is marginally below the solid+liquid/solid phase transformation temperature. This temperature is dependent upon the precise composition and may be determined metallographically. The major influence on this transformation temperature is that observed for iron, for example, for alloys containing 15% Fe the transformation temperature was determined to be 1180° C., for 17% Fe, 1170° C. and for 22% Fe, 1150° C., i.e. there is approximately 4° C. decrease in transformation temperature for 1% Fe increase in the range studied to date.

Following solution heat treatment, the alloy is quenched to room temperature and reheated to the first aging temperature in the range of 800°-860° C. for up to 20 hours. In this first aging treatment the 2-17 Sm-Co solid solution transforms into a duplex structure consisting of a continuous network of 1-5 Sm-Co phase within the 2-17 Sm-Co matrix. We have found that the first aging temperature should be precisely determined with respect to the zirconium content. For example, the optimum first aging temperature was found to be 815°±5° C. for an effective zirconium content of 2.0-2.5%. For lower zirconium contents the aging temperature should be raised. For example, the optimum first aging temperature was found to be 845°±5° C. for an effective zirconium content of 1.4-2.0%. It was found that a minimum time of about 20 hours is required at the first aging temperature to form the required 1-5 Sm-Co phase network to develop the desired coercivity. Shorter times, i.e. 10 and 15 hours, result in lower coercivities and longer times, i.e. 30 hours, do not produce any further improvements. To develop the required coercivity and loop squareness ($H_K$) it is necessary to have a continuous network of the 1-5 Sm-Co phase. This requires sufficient samarium to be present and we have found 22.5-23.5% effective samarium to be a preferred amount.

In this first aging treatment, it has been observed that the nature of the structural change taking place is critically dependent upon the temperature at which the first aging process is started, that is to say the same result cannot be obtained by using a higher temperature for a shorter time or vice versa. This behaviour is typical of a spinoidal decomposition as distinct from a nucleation and growth reaction.

Following this primary aging treatment at about 800°-860° C. the specimen must be cooled to the secondary aging temperature in the range 400°-425° C. at a critical rate. The preferred cooling rate is about 2° C./min from the aging temperature to about 600° C. and about 1° C./min from about 600° C. to the secondary aging temperature. Small variations to the above do not appear to have a deleterious effect, however cooling rapidly such as >2° C./min or very slowly such as <0.5° C./min resulted in inferior magnetic properties. It is postulated that during this critical cooling step regions of 2-17 Sm-Co phase nucleate coherently within the 1-5 Sm-Co phase network, thereby causing lattice strain and creating the coercivity[16]. This transformation is enhanced by the presence of copper in the 1-5 Sm-Co phase. From this model it is understood that faster cooling rates do not permit regions of the 1-5 Sm-Co phase to transform to the 2-17 Sm-Co phase, and slower cooling rates allow incoherent nucleation to take place without lattice strain.

In the 1-5 Sm-Co system containing copper, the aging process to develop coercivity shows an optimum temperature in the range of 400°-450° C.[16]. It was found that in 2-17 Sm-Co magnets in accordance with the invention in which coercivity and loop squareness ($H_K$) are being developed by aging the 1-5 Sm-Co phase network containing copper, the same effect applies. The optimum secondary aging temperature was found to be 410°-415° C. With secondary an aging temperature of 400° C. for 10 hours a lower loop squareness ($H_K$) was obtained as was also the case at 422° C., as shown below.

| Secondary Aging Temperature °C. | Composition % Sm 23.0 | Cu 4.6 | Fe 22 | Zr 1.9 |
|---|---|---|---|---|
| | $H_K$ (kOe) | | | |
| 400 | 7.6 | | | |
| 410 | 8.7 | | | |
| 422 | 7.8 | | | |

It has been found that a secondary aging treatment of 10 hours at 410°–415° C. is effective. It is also believed that the optimum secondary aging temperature is dependent upon the copper content.

It was found that the final cooling step to room temperature after aging at 400°–425° C. is not critical.

The present invention also provides a process for producing an $Sm_2Co_{17}$ alloy permanent magnet, containing also iron, copper and zirconium or a similar group IVB or VB transition metal, the process comprising: providing said alloy in a preliminary form, sintering said alloy at an elevated temperature to achieve a high density which results in a high remanence, selecting a solution heat treatment temperature which is marginally below the liquid+solid/solid phase transformation temperature for the preferred composition of said alloy, cooling the alloy from the elevated sintering temperature to the solution heat treatment temperature in a controlled manner such that all the alloy constituents are put into a uniform solid solution heat, holding at the solid solution treatment temperature, quenching the alloy to room temperature, reheating the alloy to the first aging temperature, which is critically dependent on the composition of said alloy, particularly the zirconium content, and holding for sufficient time for the 2–17 Sm-Co solid solution to transform into a structure consisting of a continuous network of the 1–5 Sm-Co phase within the 2–17 Sm-Co matrix, cooling said alloy to the secondary aging temperature at a critical rate and holding at that temperature for a specified time such that regions of 2–17 Sm-Co phase nucleate coherently within the 1–5 Sm-Co phase network thereby creating lattice strain which results in high coercivity and good loop squareness, and cooling said alloy from the secondary aging temperature to room temperature.

The following comments in connection with the invention are also appropriate:

1. A high sintering temperature develops a high density and this results in ultimately a high remanence. To minimize distortion a two stage process is preferred; 30 min in hydrogen at 1150° C. followed by heating in argon at 4°–5° C./min to 1205° C. and holding at this temperature for 10 min.

2. A high iron content is desirable to increase the remanence and energy product but the copper and zirconium contents must be reduced as the iron is increased to maintain the uniform 2–17 Sm-Co solid solution. Iron has the most marked effect on the solution heat treatment temperature. A preferred amount is 22% Fe and a preferred solution heat treatment temperature is 1140°–1170° C.

3. Samarium and zirconium must be regarded as "effective" amounts to allow for the presence of oxygen and carbon respectively, as taught in our co-pending application.

4. Sufficient samarium must be present to ensure that when the 1–5 Sm-Co phase network is formed within the 2–17 Sm-Co matrix in the aging process, the 1–5 Sm-Co phase network is continuous. This is necessary for good coercivity and loop squareness ($H_K$). A preferred amount of effective samarium is 23.0%.

5. The effective zirconium present has a critical effect on the precise temperature at which the above aging transformation takes place. A preferred amount of effective zirconium is 1.4 to 2.0% with aging treatments of 845°±5° C.–815°±5° C. respectively for 20 hours.

6. The copper present influences beneficially the final transformation of regions of the 1–5 Sm-Co phase network into coherent regions of 2–17 Sm-Co phase during the controlled cooling from the primary aging temperature in the range of 800°–860° C. to the secondary aging temperature and the holding at that temperature. The coherent regions of 2–17 Sm-Co phase distort or strain the 1–5 Sm-Co phase network which results in high coercivity. A preferred amount of copper is 4.6%. A preferred cooling rate is 2° C./min from 860° C. to 600° C. and 1° C./min from 600° C. to 410° C. A preferred secondary aging temperature is 410° C. A preferred holding time at 410° C. is 10 hours.

7. As stated earlier, both zirconium and copper levels must be controlled to permit the iron level to be optimized whilst still permitting all the alloying elements to go into uniform solid solution in the solution heat treatment step.

Other embodiments of the invention will be readily apparent to a person skilled in the art, the scope of the invention being defined in the appended claims.

REFERENCES

1. Wallace, W. E., "Rare Earth Intermetallics", Academic Press, New York, 1973, pages 170–172.
2. Tokunaga, M., Hagi, C. and Murayama, H., "Permanent Magnet Alloy", U.S. Pat. No. 4,172,717, Oct. 30, 1979.
3. Yoneyama, T., Tomizawa, S., Hori, T. and Ojima, T., "$R_2Co_{17}$ Rare Type Earth Cobalt Permanent Magnet Material and Process for Producing the Same", U.S. Pat. No. 4,213,803, July 22, 1980.
4. Imaizumi, N. and Wakana, K., "Rare Earth-Cobalt System Permanent Magnetic Alloys and Method of Preparing Same", U.S. Pat. No. 4,221,613, Sept. 9, 1980.
5. Tawara, Y., Chino, T. and Ohasi, K., "Rare Earth Metal-Containing Alloys for Permanent Magnets", U.S. Pat. No. 4,375,996, Mar. 8, 1983.
6. Semones, B. C., "High Energy Density Rare Earth-Cobalt Magnets and D.C. Servo Motors: A Valuable Union", Sixth International Workshop on Rare Earth-Cobalt Permanent Magnets, Baden, Vienna, Austria, 1982.
7. Hadjipanayis, G. C., "Microstructure and Magnetic Domain Structure of 2:17 Permanent Magnets", Sixth International Workshop on Rare Earth-Cobalt Permanent Magnets, Baden, Vienna, Austria, 1982.
8. Yoneyama, T., Tomizawa, S., Hori, T. and Ojima, T., "New Type Rare Earth-Cobalt Magnets Based on $Sm_2(Co,Cu,Fe,M)_{17}$", Third International Workshop on Rare Earth-Cobalt Permanent Magnets, La Jolla, Calif., 1978.
9. Yoneyama, T., Fukuno, A. and Ojima, T., "$Sm_2(Co,Cu,Fe,Zr)_{17}$ Magnets Having High $_iH_c$ and $(BH)_{max}$", Third International Conference on Ferrites, Kyoto, Japan, 1980.

10. Hadjipanayis, G. C., Hazelton, R. C., Wollins, S. H., Wysiekierski, A. and Lawless, K. R., "The Effect of Heat Treatment on the Microstructure and Magnetic Properties of a $Sm(Co,Fe,Cu,Zr)_{7.2}$ Magnet", Sixth International Workshop on Rare Earth-Cobalt Permanent Magnets, Baden, Vienna, Austria, 1982.
11. Shimoda, T., Okonogi, I., Kasai, K. and Teraishi, K., "New Resin-Bonded $Sm_2Co_{17}$ Type Magnets", Third International Conference on Ferrites, Kyoto, Japan, 1980.
12. Shimoda, T., Okonogi, I. and Teraishi, K., "Developments in Magnetic Properties of Resin Bonded $Sm_2TM_{17}$ Type Magnets", Proceedings of the Fifth International Workshop on Rare Earth Cobalt Permanent Magnets, Roanoke, Va, June 1981.
13. Fidler, J. and Skalicky, P., "Domain Wall Pinning in REPM", Proceedings of the Sixth International Workshop on Rare Earth Cobalt Permanent Magnets, Vienna, Austria, September 1982.
14. Kronmuller, N., "Nucleation and Propagation of Reversed Domains in RE-Co-Magnets", Proceedings of the Sixth International Workshop on Rare Earth Cobalt Permanent Magnets, Vienna, Austria, September 1982.
15. Rabenberg, L., Mishra, R. K. and Thomas, G., "Development of the Cellular Microstructure in $SmCo_{7.4}$ Type Magnets", Proceedings of the Sixth International Workshop on Rare Earth Cobalt Permanent Magnets, Vienna, Austria, September 1982.
16. Perry, A. J., Nagel, N. and Menth, A., "Permanent Magnetic Materials on the Basis of RE (Co, Cu)", Third European Conference on Hard Magnetic Materials, Amsterdam, Sept. 17–19, 1974.

What we claim as new and desire to protect by Letters Patent of the United States is:

1. A process for producing an $Sm_2CO_{17}$ alloy suitable for use as a permanent magnet, said alloy consisting essentially of by weight 22.5 to 23.5% Sm as an effective amount, 20.0 to 25.0% Fe, 3.0 to 5.0% Cu, 1.4 to 2.0% Zr as an effective amount, minor amounts of oxygen and carbon, an additional amount of Sm in the range of from about 4 to about 9 times the oxygen content of the alloy, an additional amount of Zr in the range of from about 5 to 10 times the carbon content of the alloy, the balance being cobalt, and optionally praseodymium in partial replacement of the samarium, and optionally another group IVB or VB transition element in at least partial replacement of zirconium, the process comprising:

providing said alloy as a powder compact, sintering said alloy at an elevated temperature to achieve a high density and high remanence, determining the solid+liquid/solid phase transformation temperature of said alloy, cooling the sintered alloy in a controlled manner from the sintering temperature to a solution heat treatment temperature marginally below the solid+liquid/solid phase transformation temperature to put the alloy constituents into a substantially uniform 2-17 Sm-Co solid solution, holding the alloy at the solid solution heat treatment temperature, quenching the alloy to room temperature, reheating the alloy to a first aging temperature to transform the 2-17 Sm-Co solid solution into a structure comprising a network of the 1-5 Sm-Co phase within a 2-17 Sm-Co matrix, cooling the alloy to a second aging temperature in a controlled manner to cause regions of 2-17 Sm-Co phase to nucleate coherently within the 1-5 Sm-Co phase network and create lattice strain which results in high coercivity and good loop squareness, and cooling the alloy to room temperature.

2. A process according to claim 1 wherein the alloy body is sintered at a temperature which is at least about 1200° C. at at least the end of said sintering step.

3. A process according to claim 1 wherein the sintering is carried out in an inert gas atmosphere.

4. A process according to claim 1 wherein the sintering is carried out in a hydrogen atmosphere.

5. A process according to claim 1 wherein the sintering is carried out in two stages, the first stage being carried out in a hydrogen atmosphere and the second stage being carried out in an inert gas atmosphere.

6. A process according to claim 1 wherein the sintering is carried out in two stages, the first stage being carried out in a vacuum and the second stage being carried out in an inert gas atmosphere.

7. A process according to claim 1 wherein the sintered alloy body is cooled from the sintering temperature to the solid solution heat treatment temperature at a rate such that from 1170° C. to the solid solution heat treatment temperature the cooling rate is about 2°-6° C./min.

8. A process according to claim 1 wherein the solid solution heat treatment temperature is in the range of from about 1120° to about 1150° C.

9. A process according to claim 1 wherein the first aging temperature is about 800°-860° C. for about 20 hours.

10. A process according to claim 1 wherein the second aging temperature is about 400°-420° C. for about 10 hours.

11. A process according to claim 1 wherein the alloy is cooled from the first aging temperature to the second aging temperature at a rate of about 1°-2° C./min.

12. A process according to claim 1 wherein sintering is carried out in two stages, the first stage being carried out in a hydrogen atmosphere at a temperature of about 1150° C., and the second stage being carried out in an inert gas atmosphere at a temperature in the range of from about 1200° to 1215° C.

13. A process according to claim 12 wherein the first sintering stage is carried out for about 30 min. and the second sintering stage is carried out for about 10 min.

* * * * *